US005345731A

United States Patent [19]

Sykes

[11] Patent Number: 5,345,731

[45] Date of Patent: Sep. 13, 1994

[54] BABY WALKER BARRIER

[76] Inventor: Jerrold Sykes, 1405 Aster Dr., Antioch, Calif. 94509

[21] Appl. No.: 996,585

[22] Filed: Dec. 24, 1992

[51] Int. Cl.[5] ..... E01C 11/22; E02D 27/32

[52] U.S. Cl. ..... 52/102; 47/33; 404/6; 404/7

[58] Field of Search ..... 52/102; 47/33; 404/6–9, 19, 35, 15; 297/5; 280/87.1, 87.2, 87.051, 772

[56] References Cited

U.S. PATENT DOCUMENTS

| | | | |
|---|---|---|---|
| D. 119,382 | 3/1940 | DePuy | 297/5 X |
| 1,509,860 | 9/1924 | Cannady . | |
| 2,755,841 | 7/1956 | Reinholz | 297/5 X |
| 2,765,839 | 10/1956 | Arpin . | |
| 3,052,248 | 9/1962 | Reuter . | |
| 3,065,680 | 11/1962 | Wiedman, Sr. | 404/6 X |
| 3,209,662 | 10/1965 | Morton | 404/6 |
| 3,326,099 | 6/1967 | Cova et al. | 404/7 |
| 3,448,963 | 6/1969 | Gravisse | 404/6 X |
| 3,491,660 | 1/1970 | Kwasney . | |
| 4,015,853 | 4/1977 | Summers | 280/87.02 W |
| 4,031,676 | 6/1977 | Dally | 52/102 |
| 4,068,968 | 1/1978 | Gagle et al. | 404/7 |
| 4,089,615 | 5/1978 | Almer et al. | 404/6 |
| 4,120,384 | 10/1978 | Choy | 188/32 |
| 4,376,594 | 3/1983 | Prosenz | 404/6 |
| 4,463,934 | 8/1984 | Ochoa et al. | 404/6 X |
| 4,480,846 | 11/1984 | Sanchez | 280/87.051 |
| 4,844,652 | 7/1989 | Schroughan | 404/7 X |
| 4,917,219 | 4/1990 | Henry | 404/6 X |
| 4,934,093 | 1/1990 | Yanna | 52/102 |
| 4,988,138 | 1/1991 | Danna et al. | 293/127 |
| 5,080,523 | 1/1992 | Steiner | 404/7 |
| 5,092,076 | 3/1992 | Terreta | 52/102 X |
| 5,134,817 | 8/1992 | Richardt | 52/102 |

FOREIGN PATENT DOCUMENTS

| | | | |
|---|---|---|---|
| 252983 | 3/1967 | Australia | 404/7 |
| 1333889 | 6/1963 | France | 404/7 |
| 1452861 | 8/1966 | France . | |
| 532413 | 8/1958 | Italy | 404/7 |
| 9378 | of 1886 | United Kingdom | 52/102 |
| 1090925 | 11/1967 | United Kingdom | 404/7 |

*Primary Examiner*—Peter M. Cuomo
*Assistant Examiner*—Suzanne L. Dino
*Attorney, Agent, or Firm*—Thomas R. Lampe

[57] ABSTRACT

Apparatus for forming a barrier on a support surface to restrict movement of a baby walker. The apparatus includes at least one elongated barrier element positionable on the support surface which is rotatable when engaged by a baby walker wheel to bring the elongated barrier element into contact with the walker body and prevent further movement of the baby walker.

6 Claims, 5 Drawing Sheets

BABY WALKER BARRIER

TECHNICAL FIELD

This invention relates to apparatus for restricting movement of a baby walker. More particularly, the apparatus is in the form of a barrier positionable on a floor or other support surface and engageable by one or more wheels of a wheeled baby walker to terminate movement of the baby walker relative to the support surface.

BACKGROUND ART

Baby walkers are well known devices for providing support to a child while allowing the child to ambulate either indoors or outdoors. Baby walkers are, for example, disclosed in U.S. Pat. Nos. 2,765,839, issued Oct. 9, 1956, 4,015,853, issued Apr. 5, 1977, and 4,988,138 issued Jan. 29, 1991.

The present invention relates to apparatus for preventing unlimited movement of a baby walker. That is, the apparatus of the present invention is for the purpose of clearly defining and delineating the area in which a baby in a walker can move so that the child cannot harm either itself or objects such as furniture or walls.

The aforesaid U.S. Pat. No. 4,988,138 teaches the idea of deploying a detachable bumper guard on a baby walker so that the walker will not harm furniture and other objects; however, such an approach does not solve the problem of limiting the operation or range of a baby walker. For example, a bumper or cage (as taught by U.S. Pat. No. 4,015,853) on the baby walker may not prevent the child from putting himself or herself in danger. For example, unrestricted movement of a baby walker may allow the child to fall into a pool, fall down stairs, or enter a busy street. Studies have shown baby walkers to be among the main causes of child injuries.

The apparatus of the present invention relates to a barrier element of specialized construction which may be readily assembled with like barrier elements to form barrier chains of different lengths and configurations. A search of the prior art failed to locate apparatus of this nature; however, patents disclosing curbs, edgers and the like, usually for landscaping and construction purposes, were located. In this connection, the following patents are noted: U.S. Pat. Nos. 5,134,817, issued Aug. 4, 1992, 4,934,093, issued Jun. 19, 1990, 3,491,660, issued Jan. 27, 1970, 5,080,523, issued Jan. 14, 1992, 4,068,968, issued Jan. 17, 1978, 4,120,384, issued Oct. 17, 1978, 1,509,860, issued Sep. 30, 1924, and 3,052,248, issued Sep. 4, 1962.

U.S. Pat. No. 4,120,384 is concerned with shopping cart braking apparatus employing a specially shaped curb and shopping cart wheel configuration to prevent removal of shopping carts from parking lots of super markets. U.S. Pat. No. 3,052,248 discloses a liquid barrier in the form of strips placed on a garage floor for water control purposes.

My co-pending U.S. patent application Ser. No. 07/939,466, filed Sep. 2, 1992, discloses an apparatus for forming a barrier to restrict movement of a wheeled baby walker on a support surface. The apparatus comprises a plurality of barrier elements including a first elongated barrier element relatively inflexible over the length thereof and a second elongated barrier element flexible and bendable over at least a portion thereof upon application of outside forces thereto, and so constructed as to enable the second barrier element to retain a bent configuration over at least a portion of the length thereof upon removal of the outside forces. In the barrier apparatus of the co-pending application, the first barrier element is engaged by a walker wheel and, by virtue of its height, prevents movement of the wheel over the barrier. There is no engagement between the barrier and the walker body itself.

DISCLOSURE OF INVENTION

The present invention relates to barrier apparatus which is cooperable with both the walker body and the walker wheels to restrict movement of a baby walker on a support surface.

The apparatus includes at least one elongated barrier element positionable on the support surface. The elongated barrier element includes first wheel engagement means positioned lengthwise along the elongated barrier element for engagement by a wheel of a baby walker.

First support surface engagement means is spaced from the first wheel engagement means and positioned lengthwise along the elongated barrier element for engagement by the support surface.

The barrier element further includes first walker body contact means spaced from the first wheel engagement means and from the first support surface engagement means. The elongated barrier element is moveable responsive to engagement of the first wheel engagement means by a baby walker wheel to bring the first walker body contact means into contact with the walker body and terminate movement of the baby walker relative to the support surface.

The baby walker body is located a predetermined distance above the support surface. The first support surface engagement means and the first walker body contact means have extremities spaced apart a distance exceeding the predetermined distance. The elongated barrier element is so configured as to jam between the walker wheel and walker body to stop further movement of the walker body in the direction of the elongated barrier element.

A barrier chain may be formed from a plurality of the elongated barrier elements and connector means is provided for interconnecting the elongated barrier elements end-to-end.

Other features, advantages, and objects of the present invention will become apparent with reference to the following description and accompanying drawings.

BEST MODE FOR CARRYING OUT THE INVENTION

Figure 1:
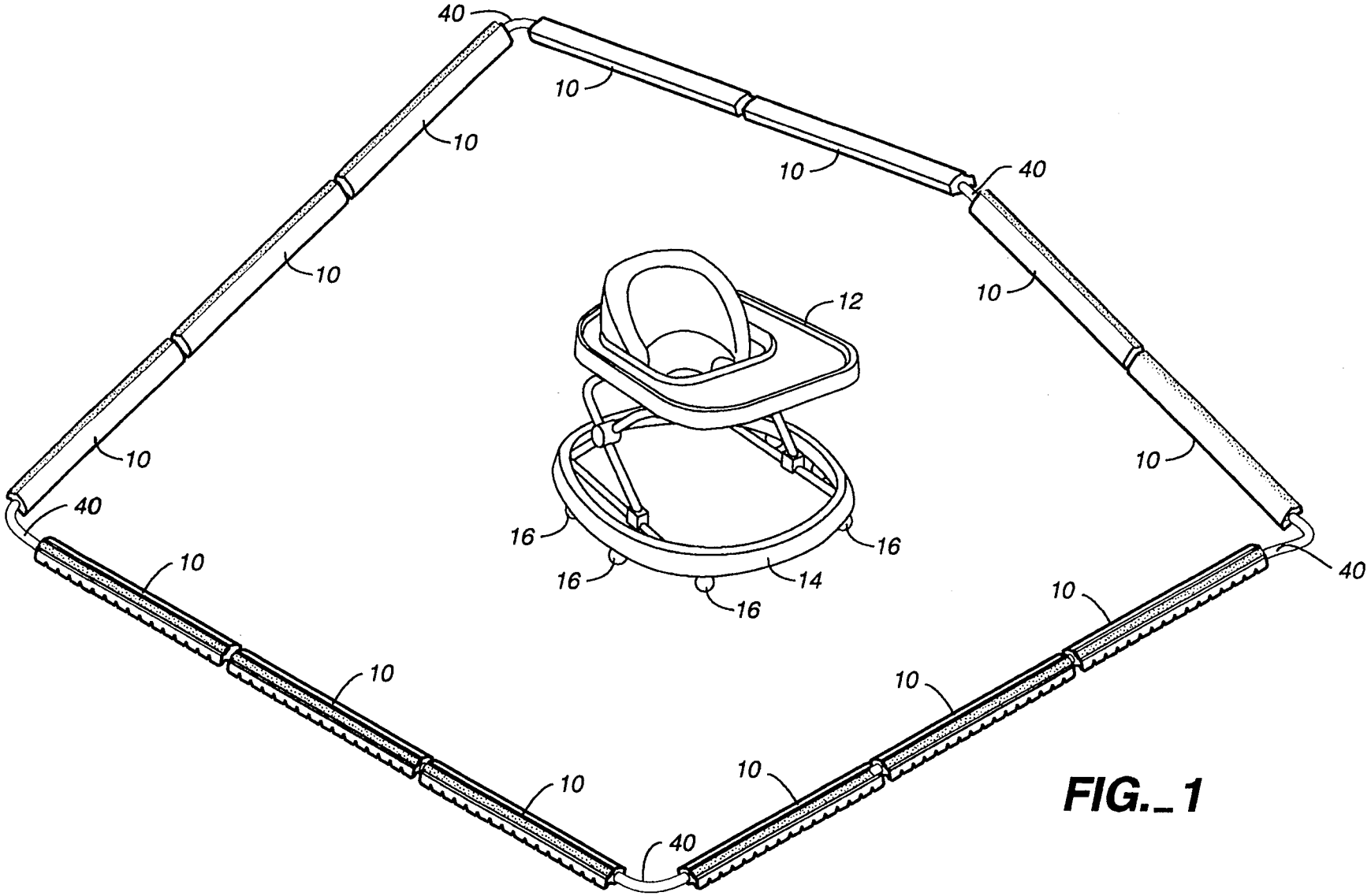
FIG. 1 is a perspective view of a barrier chain constructed in accordance with the teachings of the present invention and comprising a plurality of elongated barrier elements connected end-to-end, the apparatus surrounding a wheeled walker.
Figure 2:
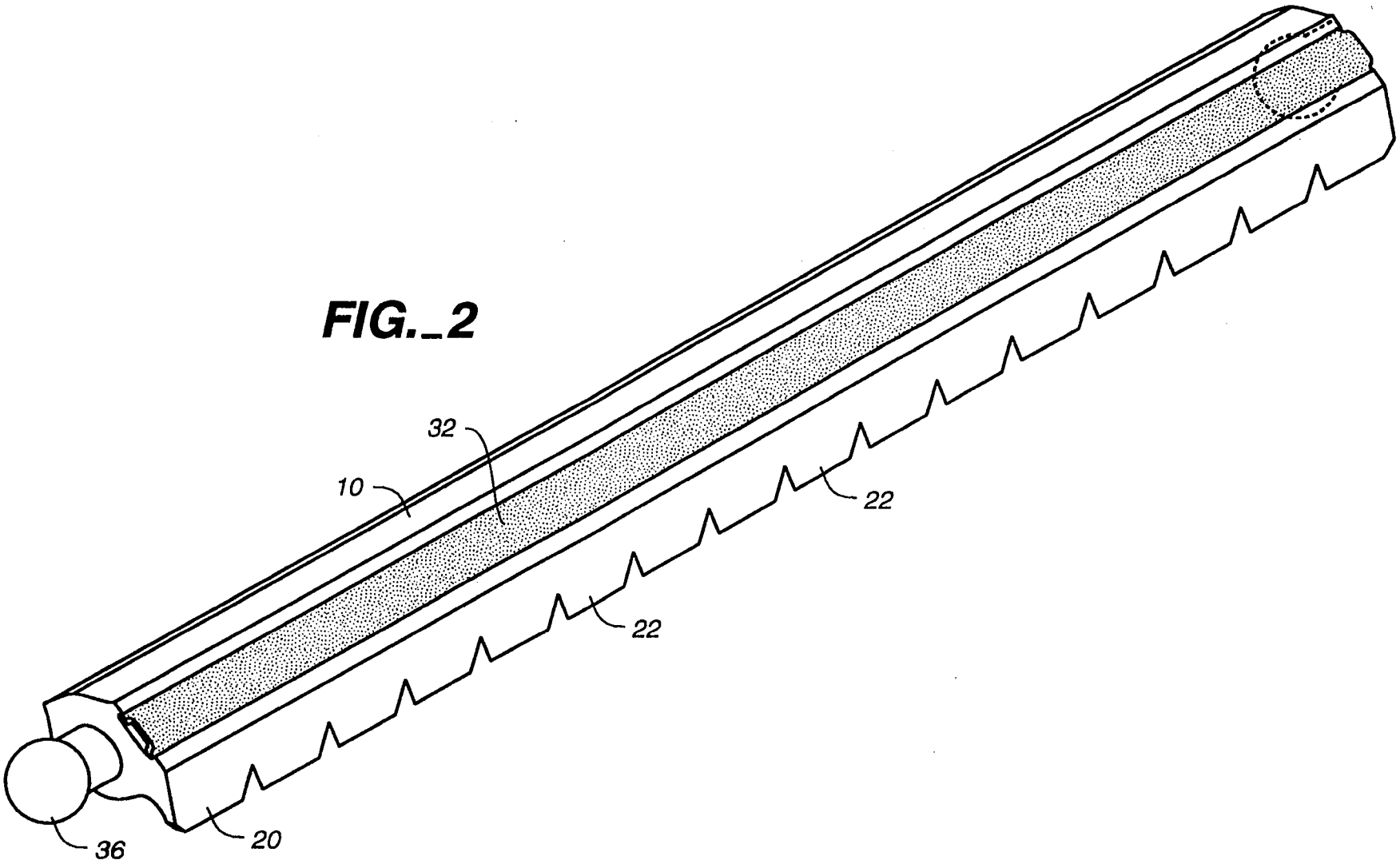
FIG. 2 is a greatly enlarged, perspective view of an elongated barrier element constructed in accordance with the teachings of the present invention.
Figure 2A:
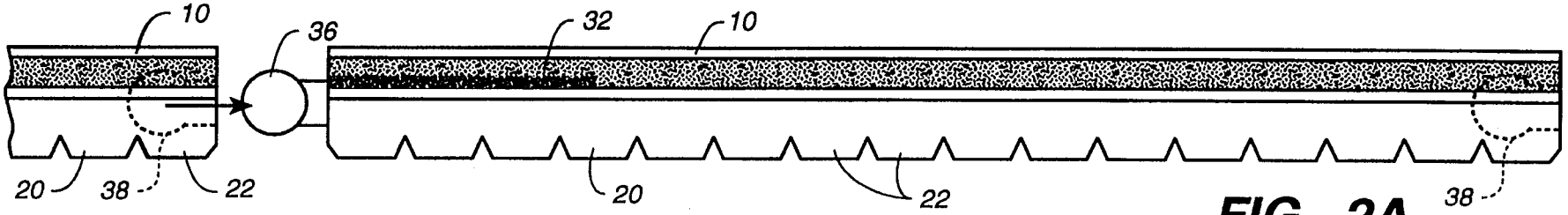
FIG. 2A is an enlarged, frontal view illustrating an elongated barrier element being attached to the end of another elongated barrier element with one form of connector means.
Figure 2B:
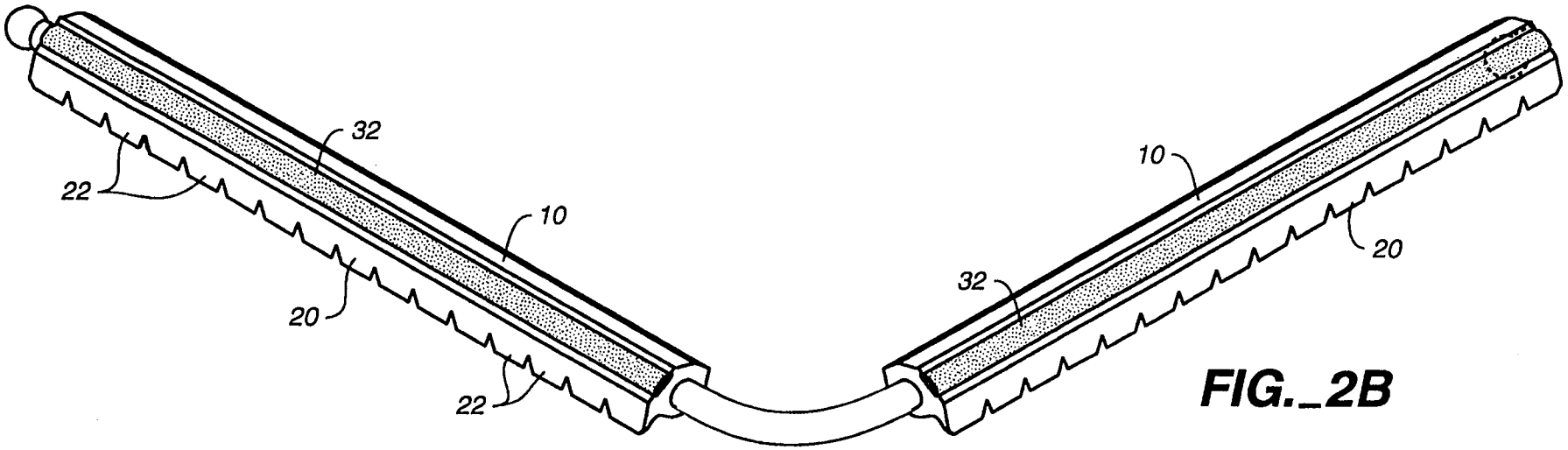
FIG. 2B is a top, perspective view showing two elongated barrier elements connected together at their ends by a flexible connector member.

Referring now to the drawings, FIG. 1 shows a barrier chain comprised of a plurality of elongated barrier elements 10 connected end-to-end and forming a barrier chain surrounding a baby walker 12. The baby walker 12 includes, as is conventional, a walker body 14 and a plurality of wheels 16 supporting the walker body. In FIG. 1, the barrier chain is closed to restrict movement of the wheeled baby walker 12 to the interior defined by the closed barrier chain or loop.

Each elongated barrier element 10 is so configured as to provide a positive means for stopping movement of the baby walker 12 in the direction of the elongated barrier element. Such positive action is accomplished by so configuring the elongated barrier element that it will react to engagement by a walker wheel to wedge or jam itself between the walker wheel and the walker body. The elongated barrier element also includes means for positively engaging the floor or other support surface to prevent movement not only of the elongated barrier element but also of the baby walker relative to the support surface. The elongated barrier element is positioned in alternative ways on the support surface, depending whether the support surface is carpeted or relatively smooth.

Figure 3A:
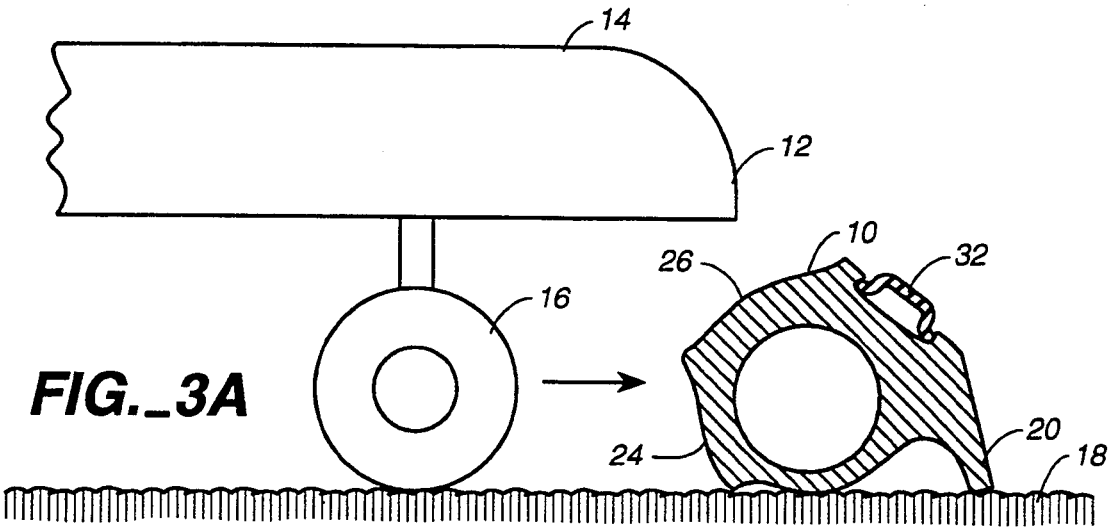
FIG. 3A is a somewhat diagrammatic, side view illustrating an elongated barrier element in cross-section positioned on a carpet and just prior to engagement by a wheel of a baby walker.
Figure 3B:
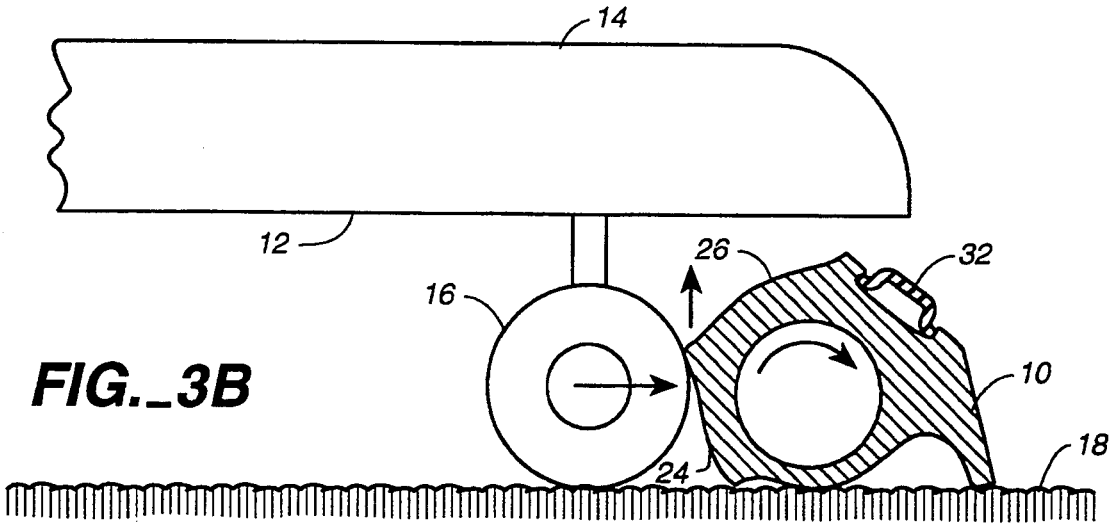
FIG. 3B is a view similar to FIG. 3A, but showing the elongated barrier element at the point of initial engagement by the baby walker wheel.
Figure 3C:
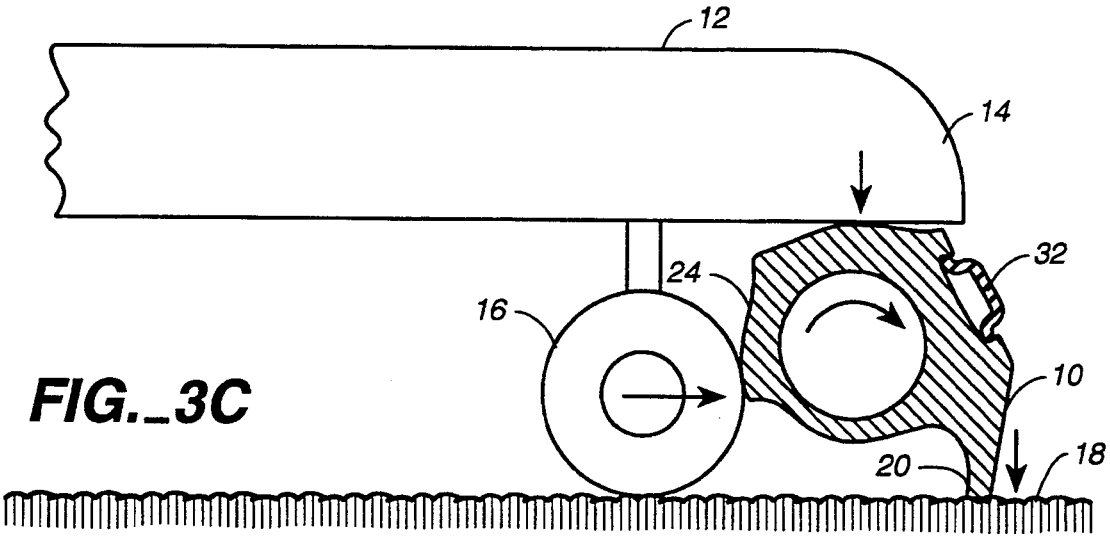
FIG. 3C is a view similar to FIGS. 3A and 3B, but illustrating the elongated barrier element having been moved by the wheel and brought into engagement with the baby walker body to terminate further movement of the baby walker.

FIGS. 2, 2A, 2B, and 3A through 3C illustrate an elongated barrier element 10 deployed on a floor which is covered by a carpet 18 (shown in FIGS. 3A–3C). The elongated barrier element, when so utilized, has a support surface engagement means in the form of an extremity 20 which is generally blade-like and has a plurality of teeth 22 for frictionally engaging the carpet. The extremity 20 is disposed along the length of the elongated barrier element 10.

The elongated barrier element 10 also includes wheel engagement means in the form of a cam surface 24 which is engageable by a wheel 16 of the baby walker. Such engagement urges the cam surface 24 upwardly as shown in FIGS. 3B, 3C, the teeth 22 of the extremity 20 acting as a fulcrum about which the elongated barrier element 10 rotates as shown by the curved arrows in these figures.

Rotational movement of the elongated barrier element 10 ceases when the walker body 14 is engaged by the elongated barrier element as shown in FIG. 3C. In the illustrated embodiment, engagement with the walker body 14 takes place at walker body contact means in the form of an elongated protrusion 26 extending lengthwise along the elongated barrier element. When the baby walker is backed away from the elongated barrier element 10, the elongated barrier element will again drop to the position illustrated in FIG. 3A.

It is to be noted that the baby walker body 14 is located a predetermined distance above the support surface, in the FIGS. 3A–3C embodiment, the carpet 18. The distance between the ends of teeth 22 and elongated protrusion 26 is greater than the distance the walker body is located above the support surface. Thus, the support surface and baby walker cooperate with the elongated barrier element 10 to wedge or jam it into position between the contacting wheel and walker body, and the elongated barrier element 10 cannot rotate beyond the position illustrated in FIG. 3C.

Figure 4A:
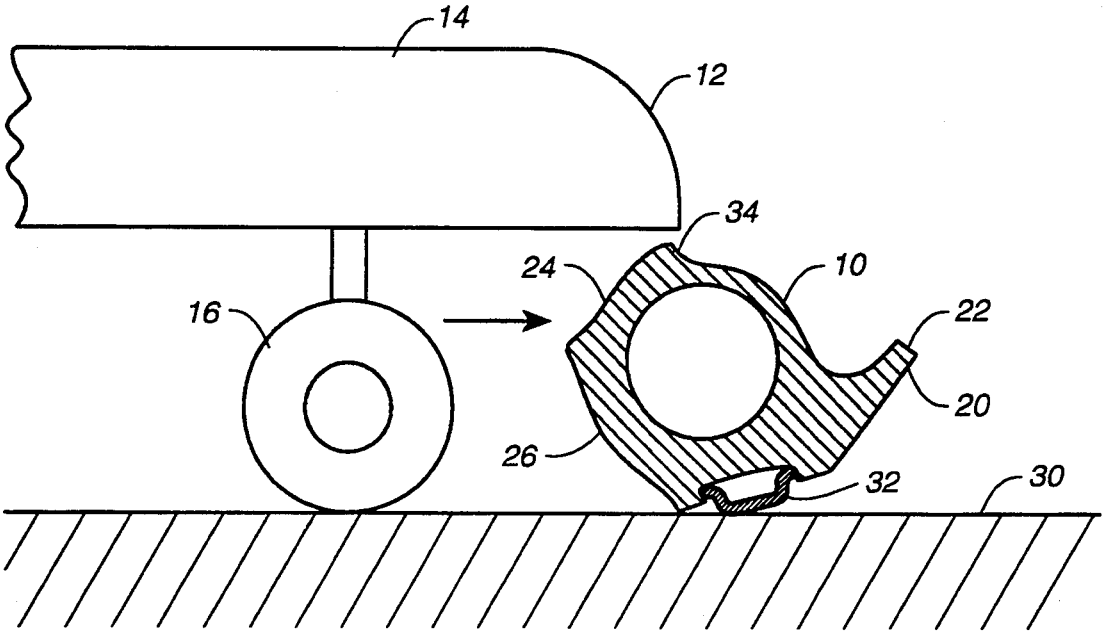
FIG. 4A is a view similar to FIG. 3A, but illustrating an alternative position assumed by the elongated barrier element relative to the baby walker, the elongated barrier element being positioned on an uncarpeted surface.
Figure 4B:
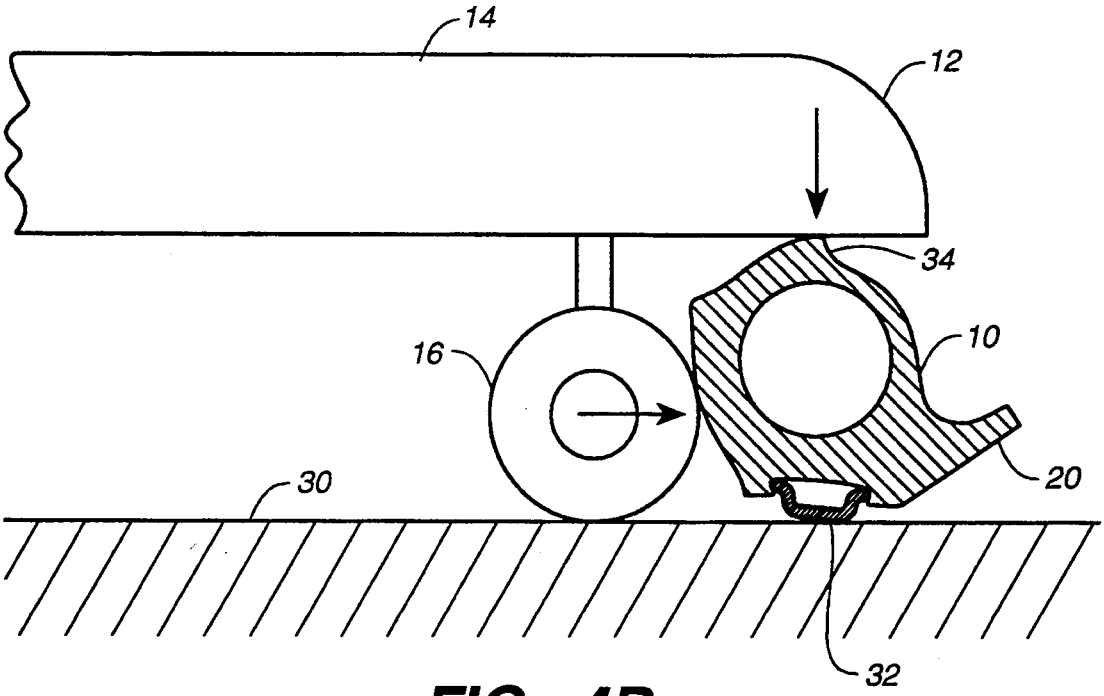
FIG. 4B is a view similar to FIG. 4A, but showing the elongated barrier element engaging the baby walker body to terminate movement of the baby walker.

FIGS. 4A and 4B show the elongated barrier element 10 assuming a different position relative to the support surface, in this case a smooth floor 30, and relative to the baby walker. When the elongated barrier element 10 is so positioned, it will engage the support surface with a support surface engagement means in the form of a resilient engagement element or strip 32 extending along the length of the elongated barrier element. In the elongated barrier element orientation illustrated in FIGS. 4A and 4B, the toothed extremity 20 does not engage the support surface. Instead, the resilient engagement element 32 will act as the fulcrum about which the elongated barrier element 10 rotates when engaged by a wheel of the baby walker as shown in FIG. 4B.

In this instance, the walker body contact means is in the form of a protrusion 34 extending along the length of the elongated barrier element. The wheel engagement means in this instance is the outer surface of the elongated barrier element 10 defining elongated protrusion 26. The elongated protrusion 26 functions as the cam surface for rotating the elongated barrier element 10 and jamming or wedging it into position between the support surface, the walker body, and the walker wheel as shown in FIG. 4B.

The resilient engagement element or strip 32 is preferably formed of a material such as rubber having some degree of resilience and having an outer surface which does not readily slide relative to the floor 30. The distance between the outer surface of resilient engagement element 32 and elongated protrusion 34 is greater than the distance between the baby walker body 14 and the floor 30.

As indicated above, the elongated barrier elements 10 are normally utilized with elongated barrier elements of like construction during use, as exemplified by the arrangement in FIG. 1 wherein a closed barrier chain is formed. For purposes of making such interconnection, each barrier element has a male connector member 36 and a female connector member or socket 38, said connector members being disposed at opposed ends of the elongated barrier element.

In the barrier chain shown in FIG. 1, the elongated barrier elements 10 are disposed in sets of either two or three and comprised of elongated barrier elements directly joined together end-to-end by their connector members 36, 38. These sets of elongated barrier elements are in turn connected together by flexible connector members 40. Flexible connector members 40, of course, have at their ends either male or female connectors (not shown) which cooperate with their opposite counterparts on the elongated barrier elements. The elongated barrier elements of the present invention may be joined together to provide any desired barrier chain configuration and, in certain circumstances, might even be utilized alone without being interconnected to other elongated barrier elements.

I claim:

1. Apparatus for forming a barrier on a support surface to restrict movement of a baby walker on said support surface when the apparatus is engaged by said baby walker, said baby walker having a walker body and wheels, said wheels supporting said walker body a predetermined distance above said support surface, said apparatus including at least one elongated barrier element positionable on said support surface and rotatable relative to said support surface, said elongated barrier element including first wheel engagement means comprising an elongated cam element having a cam surface extending lengthwise along said elongated barrier element and slanting upwardly from said support surface when said elongated barrier element is positioned on said support surface for engagement by a wheel of said baby walker, first support surface engagement means including a fulcrum element positioned on one side of said cam surface and extending lengthwise along said elongated barrier element engaging said support surface to prevent sliding of said elongated barrier element relative to said support surface when said walker wheel engages said cam surface whereby engagement between said walker wheel and said cam surface causes rotation of said elongated barrier element about said fulcrum element, and first walker body contact means comprising an elongated protrusion positioned on a second side of said cam surface and spaced from said fulcrum element with the distance between said fulcrum element and said protrusion exceeding said predetermined distance, and said elongated barrier element rotating responsive to engagement of said first wheel engagement means by a baby walker wheel to bring said protrusion into contact with said walker body and jam said elongated barrier element between said support surface and said walker body to terminate movement of said baby walker relative to said support surface.

2. The apparatus according to claim 1 wherein said elongated barrier element further includes second wheel engagement means positioned lengthwise along said elongated barrier element for engagement by a wheel of said baby walker, second support surface engagement means spaced from said second wheel engagement means positioned lengthwise along said elongated barrier element for engagement with said support support surface, and second walker body contact means spaced from said second wheel engagement means and from said second support surface engagement means, said elongated barrier element being moveable responsive to engagement of said second wheel engagement means by a baby walker wheel to bring said second walker body contact means into contact with said walker body and terminate movement of said baby walker relative to said support surface.

3. The apparatus according to claim 1 wherein said fulcrum element includes a plurality of teeth for frictionally engaging said support surface.

4. The apparatus according to claim 1 wherein said fulcrum element includes a resilient engagement element for frictionally engaging said support surface.

5. The apparatus according to claim 1 comprising a plurality of said elongated barrier elements and connector means for interconnecting said elongated barrier elements end-to-end to form a barrier chain.

6. The apparatus according to claim 5 wherein said elongated barrier elements are relatively rigid and inflexible, said connector means comprising relatively flexible connector members extending between at least some of said elongated barrier elements.

* * * * *